US005795433A

United States Patent [19]

Niedermeyer

[11] Patent Number: 5,795,433

[45] Date of Patent: Aug. 18, 1998

[54] METHOD AND APPARATUS FOR MAKING APPAREL WITH FOLDED SEAMS

[76] Inventor: William P. Niedermeyer, 1024 Mt. Mary Dr., Green Bay, Wis. 54311

[21] Appl. No.: 598,368

[22] Filed: Feb. 8, 1996

[51] Int. Cl.[6] ..... A41D 1/00; A41H 33/00; D05B 35/00

[52] U.S. Cl. ..... 156/479; 112/147; 112/475.06; 156/212; 156/226; 156/227; 156/517; 223/37

[58] Field of Search ..... 156/212, 226, 156/227, 468, 475, 476, 477.1, 479, 517, 520, 521; 223/37, 38; 112/147, 475.06, 475.09

[56] References Cited

U.S. PATENT DOCUMENTS

| | | | |
|---|---|---|---|
| 3,689,061 | 9/1972 | Nystrand . | |
| 3,823,935 | 7/1974 | Guichard | 223/37 |
| 3,870,292 | 3/1975 | Bradley . | |
| 4,003,775 | 1/1977 | Batt | 156/226 |
| 4,055,859 | 11/1977 | Green | 156/227 |
| 4,160,423 | 7/1979 | Scholl . | |
| 4,266,112 | 5/1981 | Niedermeyer . | |
| 4,289,493 | 9/1981 | Hedrich . | |
| 4,316,756 | 2/1982 | Wilson | 156/227 |
| 4,328,655 | 5/1982 | Spencer . | |
| 4,347,955 | 9/1982 | Kamal | 238/38 |
| 4,425,173 | 1/1984 | Frick . | |
| 4,448,626 | 5/1984 | Off | 156/517 |
| 4,549,916 | 10/1985 | Off | 156/227 |
| 4,699,302 | 10/1987 | Papajewski . | |
| 5,211,320 | 5/1993 | Hubele | 223/38 |

*Primary Examiner*—Daniel Stemmer
*Attorney, Agent, or Firm*—Francis J. Bouda

[57] ABSTRACT

The machine of the present invention manufactures low-cost garments out of two plys of web material, preferably non-woven material. It includes a pair of feeder mechanisms to supply two separate sheets of the web material through cutter mechanisms where the webs are cut into shapes suitable for the desired garment. The shapes of one sheet are larger than the shapes of the other sheet. The sheet with the larger shape is placed on a carrier, and the sheet with the smaller shape is placed thereupon. As the combined sheets are moved by the carrier, a plurality of folding mechanisms turns the edges of the larger sheet around the edges of the smaller sheet to create a seam which is subsequently secured, as by adhesives or sewing. The carrier may be either a rotating cylinder or it may move longitudinally. The seams may be created along machine direction lines, cross machine direction lines, or along lines at acute angles to either the direction of movement or perpendicular thereto.

18 Claims, 7 Drawing Sheets

FIG 8
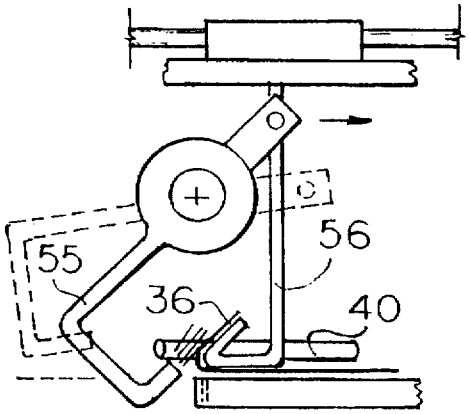
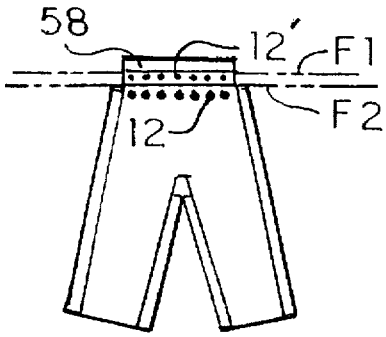
FIG 10
FIG 11
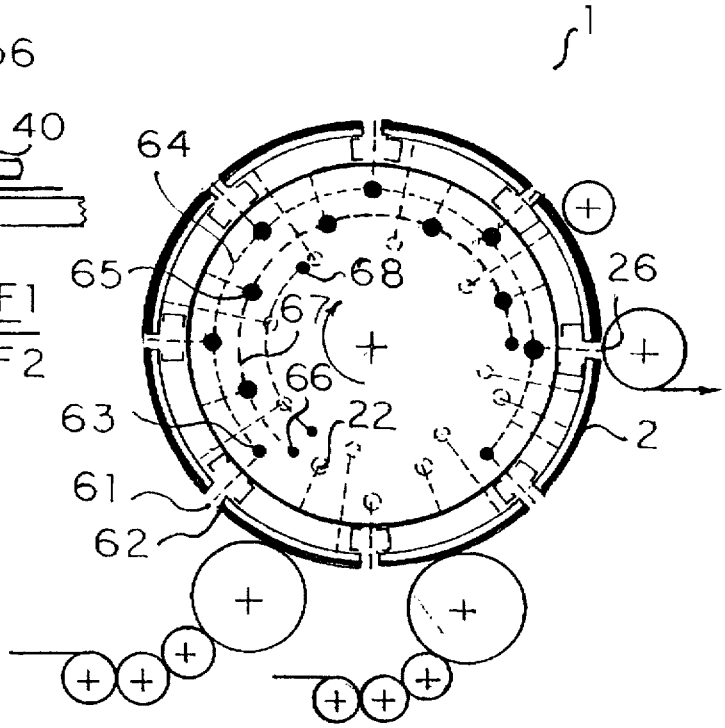
FIG 12
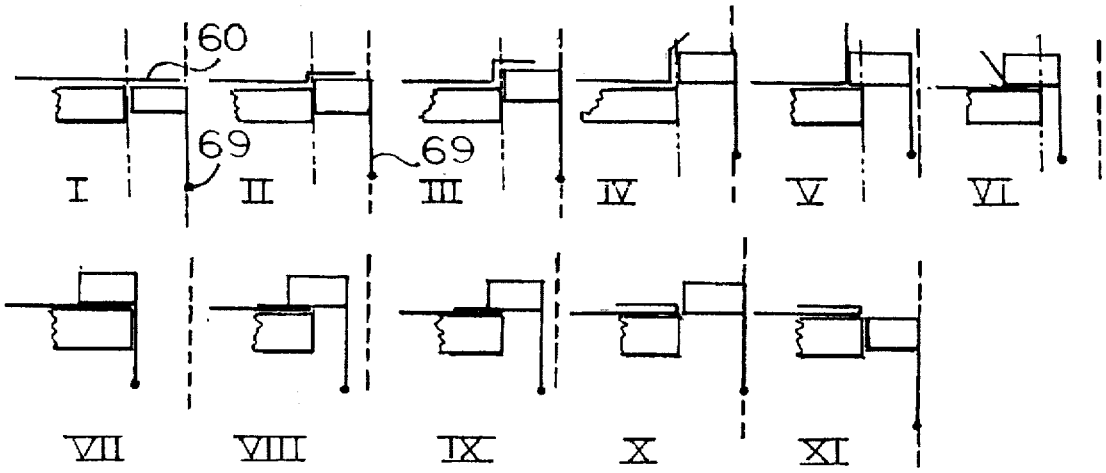

METHOD AND APPARATUS FOR MAKING APPAREL WITH FOLDED SEAMS

BACKGROUND OF THE INVENTION

Low-cost, nonwoven textiles have long promised low-cost apparel that is convenient to use and readily disposable ever since their introduction and growing use in the early 1970's.

Rapid growth in the use of disposable diapers prompted extensive R & D effort to develop high-speed manufacturing techniques like those used for diapers for making functional garments from nonwovens.

The increasing use, especially in health care and certain institutional fields, was the impetus for perfecting high-speed manufacturing apparatus and methods that would make many single use garments cost-effective. Early efforts were directed toward the successful methods used for making diapers, however, dependence on continuous web fabrication techniques imposed serious limits on the ability to replicate the special shapes and features that made conventional textile garments so functional and aesthetically appealing.

Continuous web processing especially imposes serious limitations on the types of folds that can be made because consecutive products are connected to adjacent products as consecutive parts of the same unsevered web. The resulting apparatus and methods failed to overcome these limits, thus the resultant products were functionally and aesthetically compromised.

SUMMARY OF THE INVENTION

The garments which can be made by following the teaching of the present invention are usually described as shirts, T-shirts, underwear, trousers, shirts, pants and the like. Furthermore, it is quite likely that they will be casual and informal rather than formal or dress-type, because it is the intention that the high-speed process by which the garments are made according to the present invention will use less-expensive nonwoven materials rather than other textiles. Nevertheless, it is not to be excluded from the present invention that the process and apparatus for forming these products may work just as well and effectively on more expensive textile garments.

To form the principle front-rear panel structure of a selected garment, at least two continuous webs of material are each separately advanced along different but substantially serpentine paths before they are cut into similarly shaped segments of different size.

A first segment is transferred by a selectively vacuumized roll in registered relationship to, and superposed on, the surface of selectively vacuumized platens arranged around the periphery of a folding/seaming drum.

The first segment is larger than the platen, and after the second segment (which matches the shape of the platen) is superposed on top of the first segment, the marginal extensions are folded over and secured to the second segment, thus defining conjoined front-rear panels having folded seams at pre-determined borders.

After joining and bonding of the two segments (panels), the conjoined combination is transferred by vacuum rolls to subsequent processing and packaging operations. The inventive methods and apparatus teach completion of cross-direction transverse folds, machine-direction longitudinal folds, and/or seams that are at acute angles thereto.

This teaching describes the apparatus and means to complete these important seams, but it is noted that the inventive apparatus, being an essential element of a manufacturing machine, involves cooperative placement within a series of rolls that perform numerous other functions to complete manufacture of garments, all at speeds from 50 to 200 articles per minute.

Other advantages and objects of the invention may be seen in the details of the ensuing specification.

BRIEF DESCRIPTION OF THE DRAWING

FIG. 8 is an end view of an air pressure jet folding device viewed in the direction of product movement, as in FIG. 2.

FIG. 10 is a diagrammatic sketch of a typical platen and garment shape showing a double flap extension and double fold lines at the waist.

FIG. 11 is a side elevation (essentially schematic) view of the folding/seaming drum arranged for making cross-direction folds with cooperative connections for air blast and vacuum start-stop operations shown in phantom.

FIG. 12 is a diagrammatic view of the fold sequence for a typical single transverse fold.

DESCRIPTION OF THE PREFERRED EMBODIMENT

In the following description, M.D. refers to machine direction, and C.D. refers to cross direction that is transverse and perpendicular to M.D.

Seams (hems) refer to margins of a garment that are doubled back or folded, and bonded and/or stitched. The apparatus and methods described apply primarily to the use of nonwoven materials, but are not limited thereto.

Figure 1:
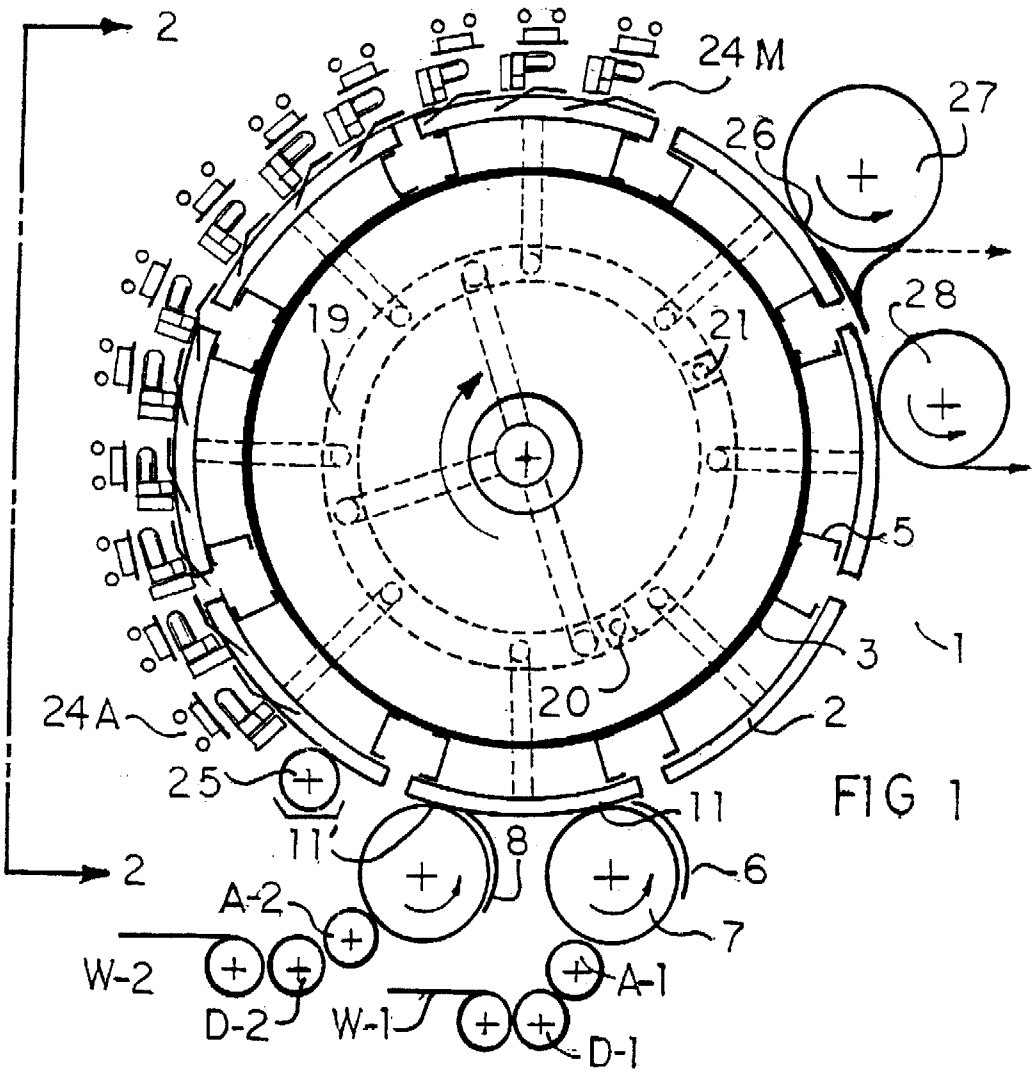
FIG. 1 is a schematic side elevation of a folding/seaming drum having eight platens cooperating with twelve seaming assemblies labeled 24 A through 24 M.

FIG. 1 illustrates construction of a folding/seaming drum arranged with co-acting rolls and referred to hereinafter as drum. Drum 1 includes a plurality of spaced apart platens 2 having an M.D. length substantially equal to length of the product.

Platens 2 are supported by spacers 5 from inner drum 3 which rotates with hollow shaft 4 and shaft 15.

Figure 4:
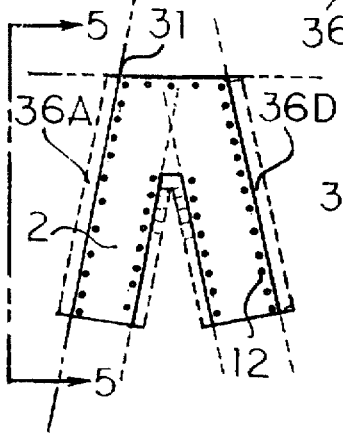
FIG. 4 is another typical platen shape with flap extensions cut in the margins at pre-determined intervals to facilitate folding.

In FIG. 1, a first web W-1 passes through die roll D-1 and anvil roll A-1 , and the resulting pre-cut shaped segment 6 is transferred to drum 1 by vacuumized roll 7 in register with shaped platens 2 (solid lines in FIG. 4). The segment 6 superposed on the platen has a slightly larger outline than the platen, and the extended material (36 of FIG. 4) remains uncovered after a second web W-2 passes through die roll D-2 and anvil roll A-2 to form a slightly smaller segment 8 which is superposed on, and in register with, first segment 6 by vacuumized transfer roll 9.

Figure 2:
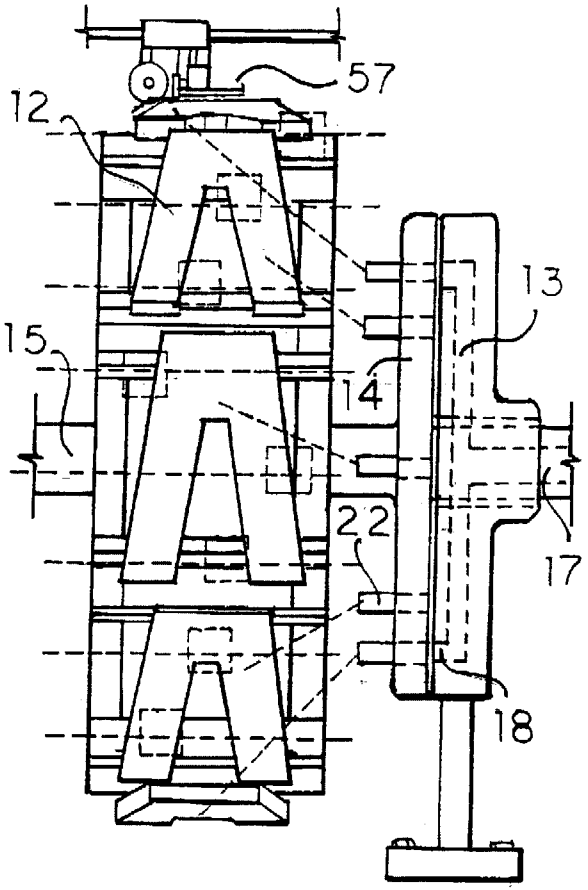
FIG. 2 is a view of the drum taken along line 2—2 of FIG. 1 with cooperating rolls deleted for clarity. A rotary vacuum valve necessary to hold product securely on the platens shows hose connections to each of 5 platens in phantom lines.

External vacuum sources for rolls 7 and 9 are not shown, but using a vacuum valve like 10 in FIG. 2, ports in the surface of rolls 7–9 can be selectively vacuumized to carry segments, and when vacuum is stopped, as at 11–11', segments 6 and 8 transfer to vacuumized platens 2, both segments being held against the surface of platens 2, by vacuum ports 12 shown as dotted lines adjacent to edges of the shaped platens, especially as at 12 in FIG. 2 (see also FIG. 4).

In FIG. 2, vacuum valve 10 is comprised of stationary portion 13 and rotating portion 14 which is connected to shaft 15 (bearing supports not shown). An external vacuum source 16 applies vacuum to ports 12 via shaft channel 17, radial channels 18 and annular groove 19 (See FIG. 1) in the stationary valve portion which communicate with rotating vacuum connections 22 during the active vacuum stage between plugs 20 and 21 of FIG. 1.

Plugs 20 and 21 can be moved in groove 19 to define the start of vacuum, duration of vacuum (length of annular groove), and when the vacuum stops.

Prior to platens reaching transfer point 11, the related vacuum valve connection 22 communicates with active vacuum groove portion 19 and applies vacuum to ports 12 of platen 2*a* etc., said vacuum remaining active until platens reach exit transfer point 26 where the product can be transversely folded in half by vacuum folding roll 27 before being transferred by roll 28 to downstream processing and packaging.

In FIG. 1, 12 folding/seaming assemblies 24A . . . 24M are shown spaced equally around the periphery of drum 1 starting after panel-to-panel adhesive is applied at roll 25 and arranged over about 180 of drum rotation in a fixed external support (not shown).

Figure 3:
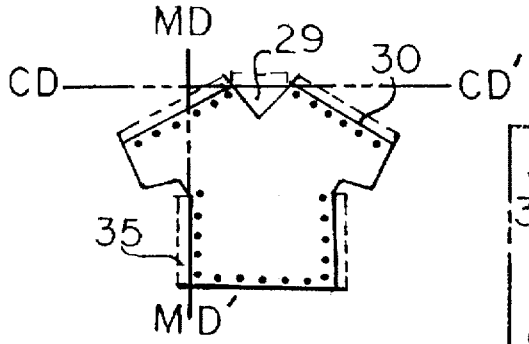
FIG. 3 is a typical platen shape shown solid. Dotted lines are vacuum ports in close proximity to borders of the shape. (Note the sloped shoulders.)

FIG. 3 shows extended tab 29 which is single-folded about transverse fold line C.D.–C.D.'

Means to achieve both single and double transverse folds are shown in FIGS. 10 through 16.

FIG. 3 shows extended tab 29 which is single-folded about transverse fold line C.D.–C.D.'

Means to achieve both single and double transverse folds are shown in FIGS. 10 through 16.

Figure 17:
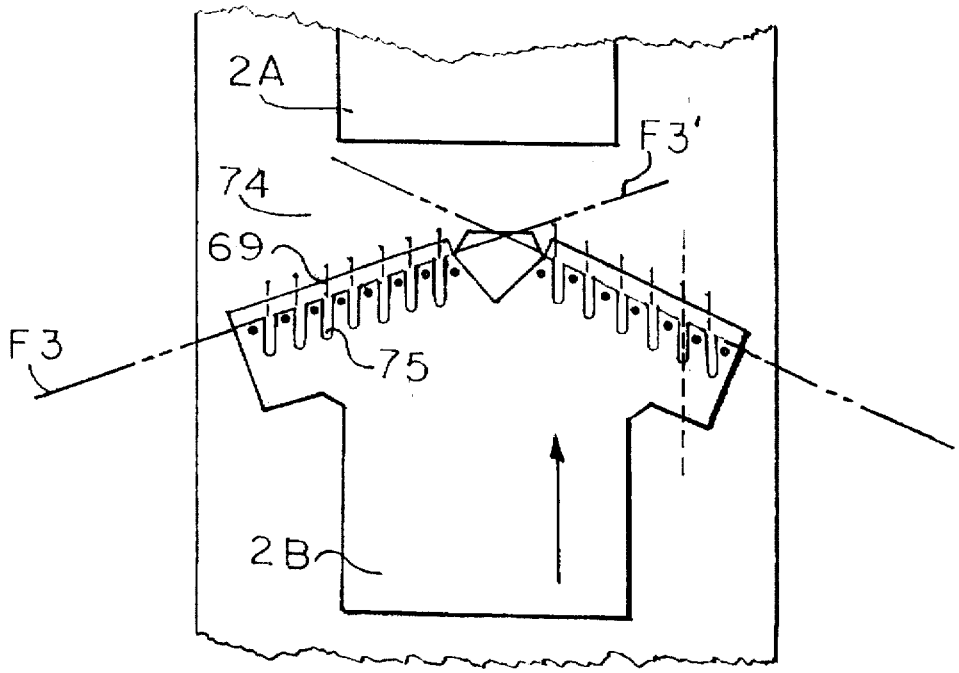
FIG. 17 is a diagrammatic top plan view of a platen arrangement for making seams along a fold line that is at an angle to a cross-direction (transverse) line.
Figure 18:
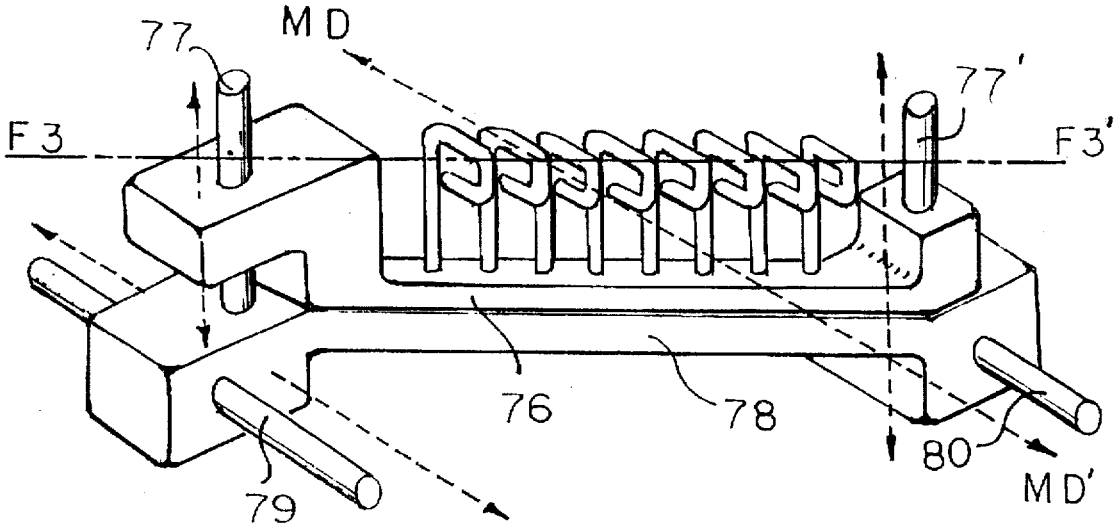
FIG. 18 is a perspective view showing an arrangement of folding fingers mounted on a sub-frame that moves vertically relative to a base frame that can be moved parallel to machine-direction.

FIG. 3 also shows tabs 30 extending along the shoulders of the garment which are to be folded along line F3–F3' with means illustrated in FIGS. 17 and 18.

FIG. 4 illustrates a typical pair of trousers with solid lines representing the outline of the outermost segment 8 (FIG. 1) and the periphery of typical platens 2. It is noted that segment 8 is superposed on first segment 6 which is of similar shape except for the extended tabs 36*a* . . . 36*d*. It is also noted that tabs 36 are folded outwardly from the platens, and all tabs, once folded, entrap outermost segment 8. Reference to the opposite folds and opposite-hand devices required is made relative to FIGS. 9 through 9C.

FIGS. 5, 6, 7 and 8 illustrate the assembly or folding means 24 for folding tabs 36. Similar but opposite hand folding assemblies 24 would be used on tabs 36*a* and 36*d* (FIG. 4).

To facilitate wrinkle-free longitudinal folds of extensions 35 of FIG. 3 or 36 of FIG. 4, these extensions can be slit at regular intervals with cuts in the extended margins before being transferred to the platens of drum 1 (cutting means not shown).

Figure 5:
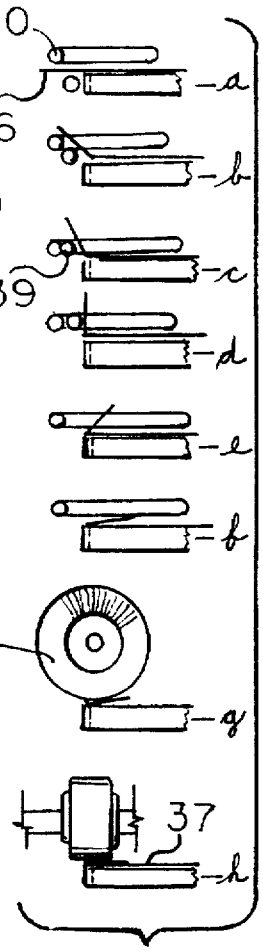
FIG. 5 is a diagrammatic series of views showing the folding sequence when viewed along line 31 in the direction of product movement.
Figure 7:
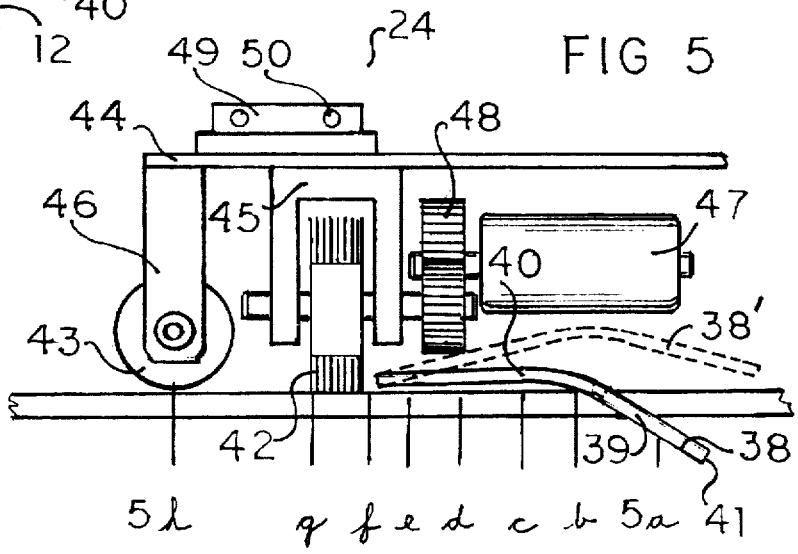
FIG. 7 is a side elevation of the folding/seaming device viewed along line 7—7 of FIG. 6.

FIG. 5 shows the sequence of folding as a web segment 6 secured to the platens 2 by vacuum ports 12 progresses through various folding/seaming elements shown in FIG. 7. These progressive segment positions are shown in FIG. 5A to 5H and are cross-referenced in FIG. 7. In FIG. 5 numeral 37 designates the folded combination including segment 8 entrapped by the folded extensions of segment 6.

For purposes of clarity and description, continuous folding rod 38 (see FIG. 7) is separated into components in the diagrammatic views of FIG. 5 which describes folds made along lines substantially parallel to machine direction; however, lines at an angle to machine direction are within the scope of the invention.

As separate elements, it is noted that the combination applies a first (upward) positive force to fold the extension flaps 36 etc., to a substantially perpendicular orientation relative to the platen surface, and a second positive force in a direction substantially parallel to the surface of the platen. The first and/or second force can be positive air pressure including the possibility that drum/platen movement through ambient air might be effective as a second force.

FIGS. 10 through 18 illustrate means to achieve folds made parallel to C.D. or in a direction at an angle thereto.

For these folds also, folding can be achieved by a single element that applies the first positive force and due to rotational movement (see FIG. 13), also applies a positive force in a longitudinal M.D. direction substantially parallel to the surface of the platens. With these folds, air pressure might be used as a first or second positive force including windage pressure due to rotation.

Referring to FIG. 7, as a platen enters a 'folding zone' defined by letters 5-A through 5-H in FIG. 7, the downwardly extended end 41 of rod 38 is substantially below the surface of platen 2 and segment 6 having extended tabs 36 extending over edges of the platen defined by line 31. As the web segment moves through the folding zones 5A through 5H, the extended tab is lifted up by rod portion 39 and urged into a reverse foldback by rod portion 40. Vacuum ports are omitted from FIG. 7 for clarity. Ports 12 along side edges for leg folds are shown in FIG. 6.

When the extended flap is folded back, a brush roll 42 can smooth out wrinkles and, downstream, ironing roll 43 applies pressure to 'set' the bond.

Brush roll 42 is supported by bracket 45 suspended from moving plate 44. Ironing roll 43 is supported by brackets 46 suspended similarly. A motor 47 rotates the brush roll through gears 48. Moving plate 44 is attached to slide bracket 49 which move on support rods 50 in a transverse direction.

Figure 6:
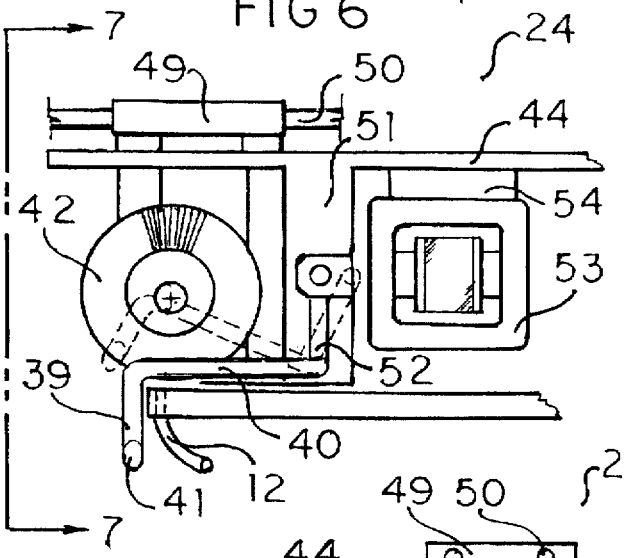
FIG. 6 is an end view schematic layout of the folding/seaming device viewed in the direction of product movement, as in FIG. 2.
Figures 9, 9A, 9B, 9C:
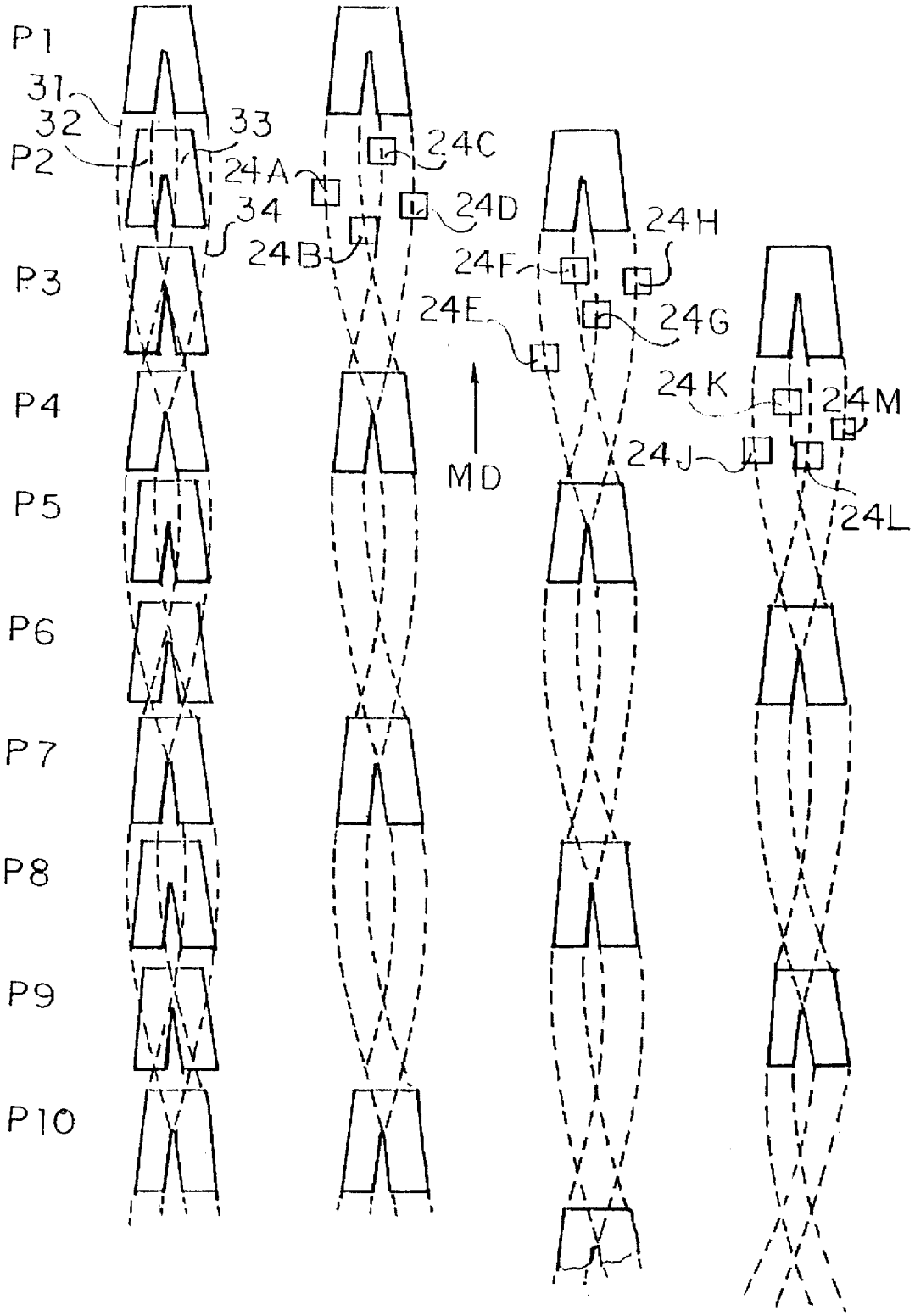
FIG. 9 is a diagrammatic illustration of the composite folder path generated relative to a series of rotating platens while the folder/seamer device is moved in a transverse direction at a pre-determined speed.
FIG. 9A is a diagrammatic view of the folder paths generated by a first series of four folding assemblies, each operative to fold different seams on product P1 and every third product thereafter.
FIG. 9B is a diagrammatic view of the folder paths generated by a second series of four folding assemblies, each operative to fold different seams on product P2 and every third product thereafter.
FIG. 9C is a diagrammatic view of the folder paths generated by a third series of four folding assemblies, each operative to fold different seams on product P3 and every third producy thereafter.

In FIG. 6, the folding components are seen along fold lines like 31 and 33 of FIG. 9. Folding rod 38 includes inclined portion 39 and skewed (relative to M.D.) portion 40 is extended to pass through support bracket 51 with radially extending portion 52 connected to solenoid 53 supported from moving plate 44 by bracket 54. Activation of the solenoid causes rod 38 to pivot to position 38' where it is above segment 8 and no longer effective for folding. The folding elements being inactive, assembly 24 being spaced above segments 6 and 8 held on platen 2 can be moved transversely without interference as will become clear from descriptions of FIG. 9 through 9C.

Referring again to FIG. 3, extended tabs 35 can be folded along line MD–MD' (and its parallel on the opposite side) using means shown in FIG. 5 through 8 but modified to remain at a fixed position without means for transverse movement.

FIG. 8 illustrates a rotatable air jet 55 operative as a first force to fold extended flaps 36 upwardly against deflector/backup plate 56, and subsequently segment 6 is moved into urging contact with a rod 40 which exerts a second force to substantially complete the fold. Rotating means, brush roll, and ironing roll are omitted for clarity.

To complete the leg folds of FIG. 9, a 'right hand' assembly like the design of FIGS. 6 and 7 would be used for folds along lines 31 and 33. A left-hand assembly of similar construction would be used to complete folds along lines 32 and 34.

In FIGS. 9, 9A, 9B, and 9C, it is noted that each folding assembly is effective and operative every third product. For example, in FIG. 9A, folding assembly 24A is offset from the centerline of the diagram to coincide with sinusoidal fold line 31. Assembly 24B next in operative sequence is also offset and will coincide with sinusoidal fold line 32. Likewise 24C coincides with 33 and 24D coincides with 34.

After completion of the fold along line 31 on product P1, the folding rod 38 is rapidly rotated to position 38' making the rod inoperative while the assembly 24 is moved into position for folding the inner seam of the right leg of product P4 (see FIG. 9A). The folding assembly thus completes a fold alternately on the outside left leg seam, then the inner leg seam on the third downstream product, etc. While rod 38' is inoperative, the assembly passes over intermediate products P2 and P3 in transit to its next repeatable position.

Downstream and operating on product P2 (see FIG. 9B), assembly 24E will fold along line 31 in similar fashion, and subsequently after folding the inner right leg seam of product P5, will repeat the folding sequence every sixth product P2, P8, P14, etc.

Further downstream (see FIG. 9C), assembly 24 J will replicate the operation and cycling of 24 A and 24 E.

Similarly and simultaneously, assemblies 24 B, F, and K fold along line 32, assemblies 24 C, G, and L fold along line 33 and assemblies 24D, H, and M fold along line 34.

The following chart shows the inter-relationships and phasing of consecutive assemblies operating on consecutive products.

| FIG. | FOLDING ASSEMBLY | | PRODUCT NUMBER | | | | | | | | |
|---|---|---|---|---|---|---|---|---|---|---|---|
| NO. | HAND | NO. | P1 | P2 | P3 | P4 | P5 | P6 | P7 | P8 | P9 |
| 9A | R | 24A | 31 | 0 | 0 | 33 | 0 | 0 | 31 | 0 | 0 |
| | L | 24B | 32 | 0 | 0 | 34 | 0 | 0 | 32 | 0 | 0 |
| | R | 24C | 33 | 0 | 0 | 31 | 0 | 0 | 33 | 0 | 0 |
| | L | 24D | 34 | 0 | 0 | 32 | 0 | 0 | 34 | 0 | 0 |
| 9B | R | 24E | 0 | 31 | 0 | 0 | 33 | 0 | 0 | 31 | 0 |
| | L | 24F | 0 | 32 | 0 | 0 | 34 | 0 | 0 | 32 | 0 |
| | R | 24G | 0 | 33 | 0 | 0 | 31 | 0 | 0 | 33 | 0 |
| | L | 24H | 0 | 34 | 0 | 0 | 32 | 0 | 0 | 34 | 0 |
| 9C | R | 24J | 0 | 0 | 31 | 0 | 0 | 33 | 0 | 0 | 31 |
| | L | 24K | 0 | 0 | 32 | 0 | 0 | 34 | 0 | 0 | 32 |
| | R | 24L | 0 | 0 | 33 | 0 | 0 | 31 | 0 | 0 | 33 |
| | L | 24M | 0 | 0 | 34 | 0 | 0 | 32 | 0 | 0 | 34 |

In the chart O denotes that the folding devices are inoperative and the assemblies are passing over that particular product in transit to the next operative position.

The illustrations of FIGS. 9–9C represent sinusoidal projections on the periphery of the drum/platens with any specified folding assembly 24 repeating the folding function every third consecutive product after passing over two intermediate products while being inoperative.

The sinusoidal projections have a 'repeat' length of six products based on the relationship of traversing C.D. speed of the folding assembly 24 relative to speed of the drum (platen) surface.

The six repeat embodiments is illustrated to show the high speed potential of the system. For example, a product cut to a length of 40" from a 48" repeat web length would travel at a surface velocity of 4800" per minute when 100 products per minute are produced. While the drum surface moves approximately 104" (from the end of the first product to the beginning of the third product), the linear actuators 57 (see top right of FIG. 2) must traverse 18" across the machine to project the sinusoidal fold lines 31, etc., necessary for folding the product shown, requiring an actuator speed of about 13 inches per second. If decreased production speeds were acceptable, it is noted drum speed would be reduced and the sinusoidal repeat tracing could be reduced to four product lengths. Four folding or assembly units 24 could be eliminated in that case.

Other embodiments are possible including a system whereby each assembly unit 24 would fold only a single specified portion of the total folding requirement, for example, a single assembly unit 24 could fold only the left outside leg portion with other assemblies used only to fold/seam only pre-selected other seams such as inside left leg, inside right leg, outside right leg, etc., repeatably.

The principles of operation illustrated allow considerable latitude in implementation depending on design production speed and design speeds of assocaited rotary and linear actuators.

It is noted that by adding sewing apparatus (not shown) after the folds are completed, for example, following the ironing roll 43, woven fabrics could be used albeit the inefficiencies/drawbacks of limited yardage per parent roll of material, the presence of continuous string of thread that would connect consecutive products, the probability of frayed edges., etc.

The above descriptions relate to folds/seams along lines parallel to the machine direction or at an acute angle thereto. Illustrations hereinafter illustrate folds made along transverse lines or lines at an acute angle thereto.

In FIG. 10, flap 58 is a double waistband extension of product P1 that can be double reverse folded to form a 3-ply waistband. Flap portion 59 is folded along line F-1 and a second portion 60 (along with previously folded 59) is folded along line F-2 .

Figure 14:
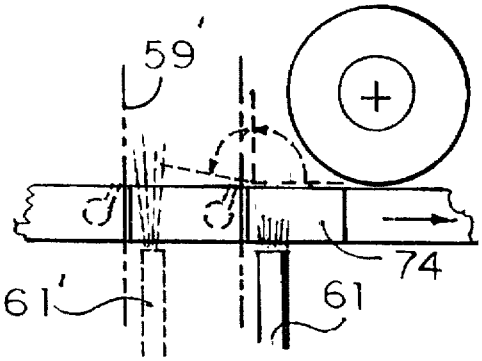
FIG. 14 is a side view of a pneumatic arrangement to complete a single transverse fold.
Figure 15:
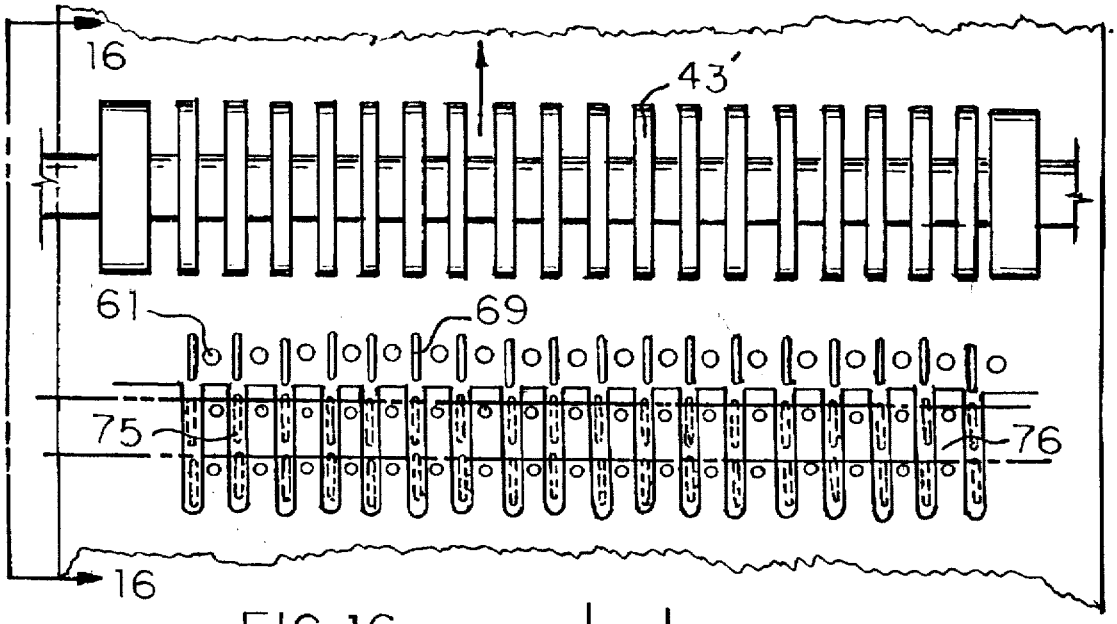
FIG. 15 is a top view (essentially schematic) of the leading edge of a platen arranged to complete a double reverse fold.
Figure 16:
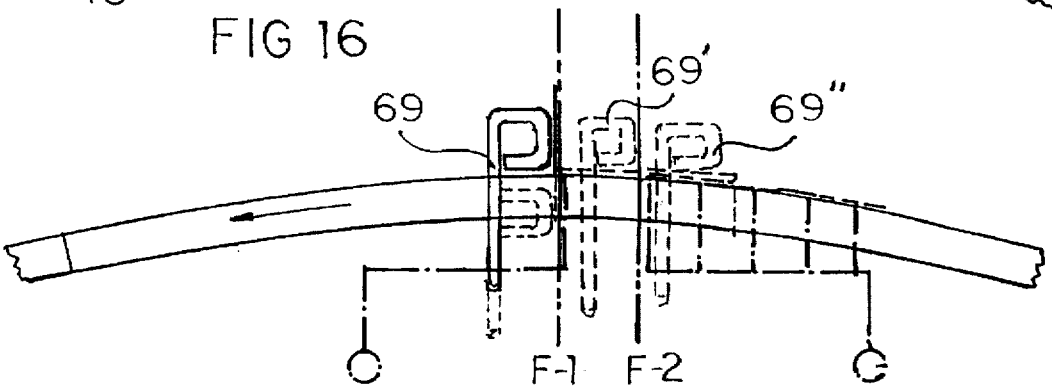
FIG. 16 is a side elevation layout viewed along line 16—16 of FIG. 15.

The double reverse fold of FIG. 10 requires the air pressure means 61 of FIG. 14 or the mechanical finger device shown in FIGS. 15 and 16.

Figure 13:
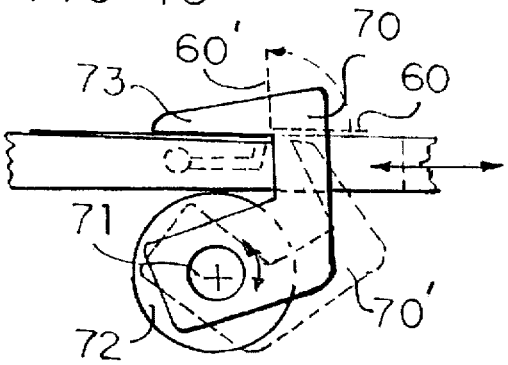
FIG. 13 is a side view of a mechanical arrangement used to complete a single transverse fold.

A singlefold transverse fold, for example, only portion 60 folded along line F-2 would use a non-movable single position air jet nozzle 61 of FIG. 14, the mechanical rotary means of FIG. 13, or a single position finger arrangement like 69' of FIG. 16.

FIG. 11 illustrates a schematic side elevation of a folding/seaming drum 1 which is similar to drum 1 of FIG. 1 without assembly units 24 and with a somewhat different arrangement of vacuum grooves as required for C.D. folds.

FIG. 11 illustrates the starting, stopping, and duration (length) of air pressure and vacuum channels for achieving a double reverse fold.

Referring to FIG. 11, after both segments are superposed on platen 2, an adhesive pattern is applied or extruded to outermost segment 8 as at 25 (not shown in FIG. 11—see FIG. 1) and immediately thereafter, air blast nozzle 61 mounted in front (upstream) of the leading edge 62 of platen 2 begins (as at 63) and continues in communication with air pressure annular manifold 64 until the drum has rotated past product exit transfer point 26.

To hold segments securely against the platen, vacuum is applied to ports 12 which are proximate to fold line F-2 and to all other vacuum ports arranged adjacent the periphery of the platen (see also FIG. 14).

The rotating vacuum connections 22 for each platen establishes communication with vacuum slot 67 before air blast begins, as at 66. At the same time, vacuum is applied to secondary ports 12' which are only aligned proximate to fold line F-1 of FIG. 10. When the fold is completed on segment 59, the vacuum to ports 12 is stopped as at 68, and means for making the second fold becomes activated. During the second fold, vacuum along line F-2 and the periphery of the article is maintained until it is stopped as at 26' for exit transfer at 26.

FIG. 12 is a diagrammatic folding sequence using fingers 69 of FIG. 15 and 16. In FIG. 12, fingers are moved vertically from a position below extension 60 to a first position 69, then horizontally to complete a singlefold. By reverse action, fingers are moved to a position below the now-folded segment extension directly below 69' in FIG. 16, and would move upwardly to position 69' as it applies the 'first force', and horizontally to position 69" to complete a second fold, as in FIG. 16.

In the singlefold sequence of FIG. 12, numerals I through XI show the sequence of a single fold made along a C.D. fold line for the first fold of the above description. To complete a single fold in FIG. 12, an upward 'first force' is exerted to urge extension flap 60 of segment 6 to a vertical orientatation (perperpendicular/to platen surface) until the shaped portion of the fingers is above the upper surface of web segment 8, (FIG. 12 IV), whence the finger is moved parallel to the platen surface (FIG. 12V through VIII) to complete the folded entrapment of web 8 by extension 60. Fingers are then withdrawn (FIG. 12 IX through X) and lowered (FIG. 12 XI) to the ready position for the next cycle.)

FIG. 13 illustrates a device for making a single transverse fold. A C-shaped finger 70 mounted on shaft 71 for pivotal rotation by means 72. Before the start of a fold, finger 70 is pivoted, below the extension of web segment 6, as shown in phantom 70'.

By rotation counter-clockwise as shown, finger 70' exerts an upward first force til extension 60 is substantially vertical and by continued rotation, tip 73 of finger 70 exerts the second horizontal force and subsequent clamp-like downward force to complete entrapment of web segment 8.

Besides the air pressure and vacuum grooving required for the doublefold of FIG. 11, FIGS. 14–15 and 16 illustrate typical arrangements for folding devices used.

FIG. 14 illustrates a simplified folding device utilizing only a first force air jet 61 (see also FIG. 11) mounted in front (upstream) of the leading edge of each platen in space 74 therebetween. Directed radially outward, the air blast lifts extension flap 59 to a substantially vertical positions, and the windage effect created by drum rotation through ambient air can apply the second force needed to complete the fold. Air jet nozzles mounted on a fixed external frame (not shown) or the use of an externally fixed brush roll, etc., are within the scope of this invention.

When the first fold is completed, the air jet is interrupted, and the air jet device is moved to a second position as at 61' while the leading fold line of vacuum ports is deactivated (as at position 68 of FIG. 11). When properly repositioned, air blast 61' is used to fold the now-conjoined (superposed and bonded) extension 59 and portion 60.

FIG. 15 illustrates an arrangement using fingers 69 to complete a double fold. In the lower part of FIG. 15, air blast jets 61 are shown between adjacent fingers 69 and positioned under flap 59 (not shown). Vacuum holes 12 are close to front edge 62 of the platen and define fold line F1.

While air jets may be adequate for the 'first force' folding operation, fingers 69 can act in cooperation with air jet 61 for the first fold, and acting alone or in cooperation with the second 'windage' force, are used to complete the fold. Subsequent smoothing of the fold by a brush roll like 42 and setting the bond with roll 43 can be included (as in FIG. 6). Note that ring portions 43' of the ironing roll line up with and bear on land 76 which is between adjacent slots 75.

Referring to FIG. 16, fingers 69 complete the sequence of folding shown in FIG. 12. After the first fold along line F-1, vacuum ports 12' are deactivated. Ports 12 along fold line F2 are still active and in communication with a vacuum source. When the first fold is completed, fingers 69 move in reverse, are lowered, move to a second position under flap segment portion 60 directly below position 69', then moved upward (means not shown) to position 69' while exerting first upward force, and finally, to position 69" to complete the second fold along line F2. Fingers are then moved to a position below 69 in preparation to fold the next segment to be superposed on the same platen on the next revolution of the drum.

FIG. 17 shows two platens 2A and 2B separated by space 74. The shirt-shaped platen has slots 75 in the leading edge, said slots being aligned with a plurality of folding fingers which are initially positioned below the segment being folded.

FIG. 18 illustrates an embodiment that allows folds to be made along fold lines skewed relative to a C.D. line.

F3–F3' is at an acute angle to a C.D. line and the plurality of fingers 69 . . . 69N are each mounted parallel and coincidentally slots 75 of FIG. 15 in the machine direction, and each is secured to a sub frame 76. An elongated element of sub frame 76 extends under the platen in a line generally parallel to the skewed fold line F3–F3'. The sub frame can be moved vertically (means not shown) along vertical shafts 77 which are supported by and anchored in base frame 78. Frame 78 is slideably moved on horizontal shafts 79 and 80 in a direction parallel to M.D. Essentially, sub frame 76 moves in machine direction, and with fingers mounted in the skewed (canted) portion of the sub frame each of the fingers moves along lines parallel to M.D. lines coincident with extended slots 75 of FIG. 15 while each of the fingers remains equidistant from F2–F3' or lines parallel thereto. In FIG. 18 note that portions of each finger are in close and equal proximity to the fold line.

Figure 19:
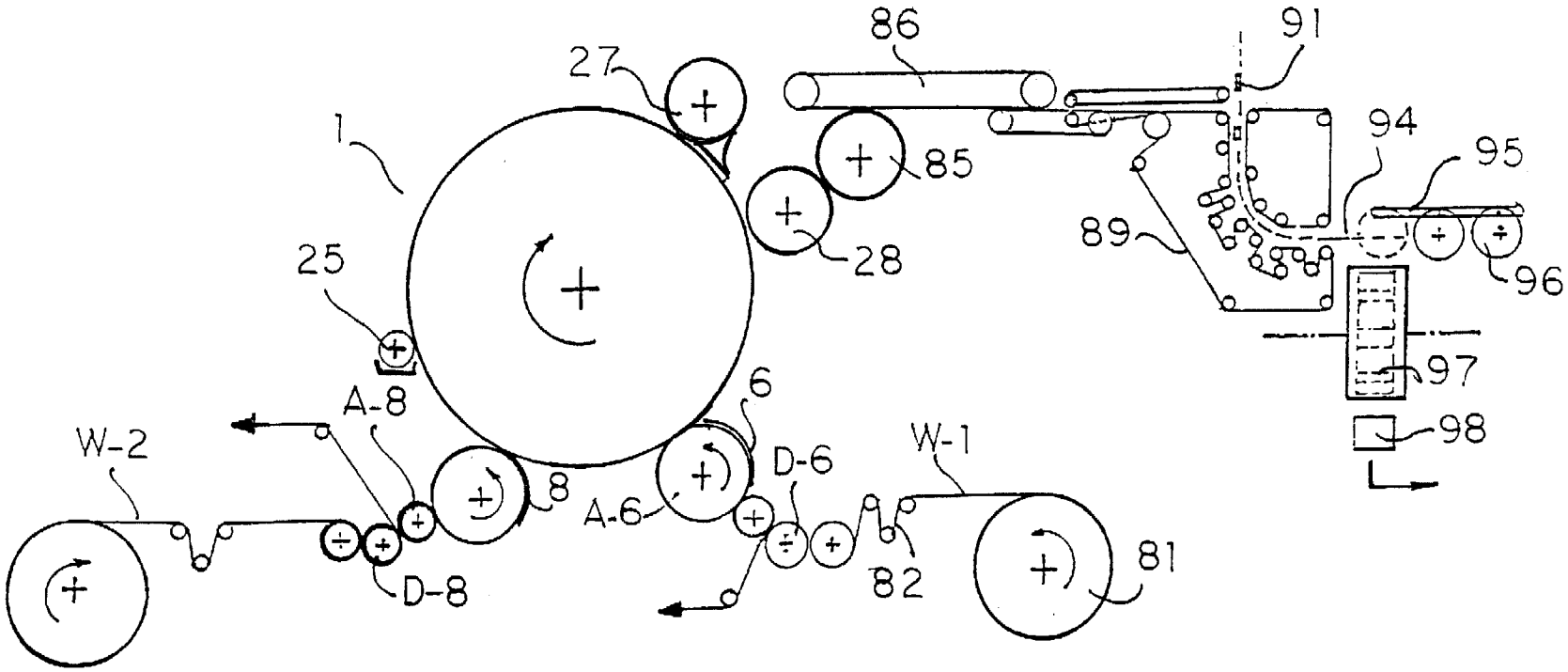
FIG. 19 is a schematic side elevation of a manufacturing machine (according to the methodology described in the summary of the invention) to make the garment illustrated in FIG. 3.

In FIG. 19, a first parent roll 81 feeds web W-1 through a constant tension device 82 and advances the web along a serpentine path through die roll D-6 and anvil roll A-6 to produce a first segment 6 which is transferred to a drum 1 having platens 2 (see FIG. 1).

In like manner, a second web W-2 is passed through a constant tension device then through the byte between die roll D-8 and anvil roll A-8 to form segment 8 which is transferred to drum platens 2 in registered superposed relationship to first segment 6.

After the second web is on the platen, a bonding agent is applied to segment 8 (as at 25) before the folds are made.

Folding of flap extension 29 of FIG. 3 will occur along a transverse fold line C.D.–C.D.' using one of the methods described in FIGS. 10 through 16, and folding of extensions 30 along fold line F3–F3' is achieved using the devices and methods described in FIG. 17 and 18.

When the conjoined and bonded product reaches vacuum folding roll 27, a cross fold reduces the M.D. length to one-half size, and after vacuum transfer via rolls 28 and 85, product is transported by vacuum belt 86 to an orbital blade folder 91.

Rejected product can be selectively stripped from transfer roll 28 (means not shown). The general arrangement disclosed in U.S. Pat. No. 4,519,596 can be used as at 89 through 94.

A second orbital blade folder 96 can be used at right angles (blade aligned in M.D.) to fold the product to one-half width by blade 95.

A well-known pair of sealing drums 97 can place the product into a pouch package as at 98.

In the illustrations and descriptions above, the leading edge transverse foldover occurs in a direction opposite to the machine direction; however, the same elements can be used to fold the trailing edge of a segment in the same direction as movement of the surface of the drum or other carrier means.

It is within the scope of this invention to complete different folds on separate drums, or to have the necessary instrumentalities arranged on the same drum.

It is also within the scope to have folding means like FIGS. 6–7 suspended from slide brackets 49 and being rotatably mounted about an axis which is perpendicular to the transverse direction in a generally radial plane.

It is furthermore to be understood that the present invention may be embodied in other specific forms without departing from the spirit or special attributes; and it is, therefore, desired that the present embodiments be considered in all respects as illustrative and, therefore, not restrictive, reference being made to the appended claims rather than to the foregoing description to indicate the scope of the invention.

Having thus described the invention, what is claimed as new and desired to protect by Letters Patent are the following:

1. Apparatus for mechanically assembling two webs of material to form garments, said apparatus including:

a first and a second web advancing means to move and cut said webs, a carrier moving in a path having a beginning and an end, said first web advancing means comprised of a die roll in operative cutting contact with an anvil roll for cutting from a first web a series of first segments having a first size and shape, said anvil roll being selectively vacuumized to advance said first segments to said carrier near the beginning of said path, said second web advancing means comprised of a die roll in operative cutting contact with an anvil roll for cutting from a second web a series of second segments having a second size and shape substantially corresponding to, but smaller than, said first size and shape of said first segment, said anvil roll being selectively vacuumized to advance said second segment to said carrier on top of said first segment, assembly means arranged for folding portions of said first segment over said second segment, said carrier having a plurality of platens and vacuum means with holes in said platens connected to said vacuum means, each of said platens arranged to hold one of said first segments in said series of first segments against the surface of said platen, and one of said second segments in said series of second segments in superposed relationship to said first segment while said carrier moves along said path in coacting relationship with said assembly means, said assembly means arranged for operation during a portion of movement along said path to fold portions of said first segment which extend beyond the edges of said second segment around and over the edges of the second segment while both segments are held against said platens by vacuum, joining means to secure said portions of said first segment to said second segment while both of said superposed segments are held in place on said platens by the vacuum means, and means to serially remove the assembled first and second segments from said plurality of platens as the platens approach the end of said path.

2. The apparatus of claim 1 wherein said platens on said carrier means include vacuumized holes along, and proximate to, edges of said platens to define a fold line around which portions of said first segment are folded and superposed on top of said second segment, and said folding assembly on said carrier includes means to complete said fold along a line that is at an acute angle to a line perpendicular to the direction of segment movement along said path.

3. The apparatus of claim 1 wherein said vacuum means include valves to control the vacuum in said platens.

4. The apparatus of claim 1 wherein said platens each are of a size and shape corresponding substantially to the size and shape of said second segment.

5. The apparatus of claim 1 wherein the holes in said platens are arranged near the edges of said platens whereby to hold the edges of said first and second segments tightly together and against said platen when said assembly means fold the extended portions of said first segment around the edges of said second segment.

6. The apparatus of claim 1 wherein the carrier is a rotatable drum and the path is circular.

7. The apparatus of claim 1 wherein said assembly means include:

a means for applying a first force to form a first fold, and a means for applying a second force to form a second fold, said second fold being made about said second segment to entrap the second segment.

8. The apparatus of claim 7 wherein at least one of the means for applying said forces is a finger.

9. The apparatus of claim 7 wherein at least one of the means for applying forces said forces is an air jet.

10. The apparatus of claim 7 wherein said means to apply a second force is activated in the same direction as segment movement.

11. The apparatus of claim 1 wherein said assembly means includes a brush roll mounted for contacting engagement with the surface of a segment after said folds are completed.

12. The apparatus of claim 1 wherein said assembly means is arranged for movement along a stationary transverse line while said carrier moves in a direction at an angle to said transverse line.

13. The apparatus of claim 1 wherein said joining means includes means for bonding using an adhesive.

14. The apparatus of claim 1 wherein said joining means includes means for stitching.

15. The apparatus of claim 1 wherein said platens are spaced apart areas of said carrier and are defined by selected portions of the carrier that have been removed.

16. A method of combining two webs to form a garment, said method including:

providing a first web and a second web, advancing said first web along a first path, advancing said second web along a second path, cutting a first segment from said first web, cutting a second segment from said second web, said second segment being smaller than said first segment, providing a carrier which travels along a third path having a beginning and an end, providing a plurality of platens supported on said carrier whereby to move said platens along said third path, creating a vacuum at the surface of each platen, applying said first segment to the surface of a platen near the beginning of said third path and holding said first segment on said platen by vacuum, aligning said second segment on top of said first segment with edges of said first segment which are not covered by said second segment extending beyond the edges of the second segment, providing at least one assembly means to fold portions of said first segment where portions of said first segment extend beyond the second segment around and above the edges of said second segment to create an overlapping border whereby said border entraps margins of said second segment, combining said first and second segments by joining said first and said second segments where they overlap, and removing said combined first and second segments from said platen near the end of said third path.

17. A method of claim 16 wherein said assembly means is attached to said carrier and said assembly means is arranged to fold the extended portion of said first segment around and over said second segment while a fixed portion of said assembly moves along said third path.

18. A method of claim 16 wherein said assembly means is mounted to an external fixed framework, and said carrier moves past said assembly means to complete the fold.

* * * * *